US006268701B1

(12) United States Patent
Tomme

(10) Patent No.: US 6,268,701 B1
(45) Date of Patent: Jul. 31, 2001

(54) FLUORESCENT LIGHT BALLAST CONVECTIVE COOLING MEANS

(76) Inventor: Michael L. Tomme, 151 Meadowview Ct., Terrell, TX (US) 75160-5341

( * ) Notice: Subject to any disclaimer, the term of this patent is extended or adjusted under 35 U.S.C. 154(b) by 0 days.

(21) Appl. No.: 09/572,005

(22) Filed: May 15, 2000

(51) Int. Cl.[7] ..... H01J 7/24

(52) U.S. Cl. ..... 315/117; 315/118

(58) Field of Search ..... 348/131; 315/32, 315/112, 117, 118

(56) References Cited

U.S. PATENT DOCUMENTS 3,705,576 * 12/1972 Roth ..... 128/1 B
4,954,891 * 9/1990 Burk et al. ..... 358/101

* cited by examiner

*Primary Examiner*—David Vu
(74) *Attorney, Agent, or Firm*—John D. Gugliotta

(57) ABSTRACT

A flourescent light is provided with an integral fan for cooling purposes. The air is filtered by a small replaceable filter that keeps dust and dirt out of the fixture. The fan is wired in parallel with the light fixture such that the fan comes on automatically whenever the fixture is energized. Air vents are also placed in the housing for both the entrance and exit of the air.

3 Claims, 2 Drawing Sheets

FLUORESCENT LIGHT BALLAST CONVECTIVE COOLING MEANS

RELATED APPLICATIONS

The present invention was first described in Disclosure Document No. 464,280, filed on Oct. 28, 1999. There are no previously filed, nor currently any co-pending applications, anywhere in the world.

BACKGROUND OF THE INVENTION

1. Field of the Invention

The present invention relates generally to flourescent lighting and, more particularly, to a cooling device or system for a fluorescent light bulb for the purpose of keeping the ballast cool.

2. Description of the Related Art

Fluorescent lighting has found wide spread use in homes, offices, and industrial establishments around the world. The ability of fluorescent lights to produce light with good color rendition in an energy efficient manner make them very popular with everyone. However, one factor associated with the use of these lights that is not popular is the maintenance required. Not only do the lamps require replacement, but the ballasts do as well. Additionally, ballast replacement does involve a fair deal of labor. This is especially costly in areas that are hard to access such as high ceiling areas. As is common with most electrical and electronic device failures, the most prevalent cause of ballast failure is high temperature. Ballasts have to deal with elevated temperatures not only from operation, but from their location at ceiling level.

In the related art, a search did not disclose any patents that read directly on the claims of the instant invention; however, the following patents disclose a compact fluorescent lamp with convective venting for cooling the ballast:

U.S. Pat. No. 5,717,277 issued in the name of Simonovitch;

U.S. Pat. No. 4,871,944 issued in the name of Skwirut et al.; and

U.S. Pat. No. 4,300,073 issued in the name of Skwirut et al.

The following patents describe a fixture for the mounting and cooling of fluorescent lamps: U.S. Pat. No. 5,174,646 issued in the name of Siminovitch et al.; and U.S. Pat. No. 3,965,345 issued in the name of Fordsmand.

U.S. Pat. No. 5,537,301 issued in the name of Martich discloses a fluorescent lamp heat-dissipating apparatus.

U.S. Pat. No. 4,503,358 issued in the name of Kamei et al. describes a fluorescent lamp having separate cooling means for the ballast and fluorescent tube.

U.S. Pat. No. 3,974,418 issued in the name of Fridrich discloses a fluorescent lamp with ballast resistor and cooling means therefor.

Consequently, there is a need for a means by which the ballasts of fluorescent lighting fixtures can be kept cool for increased operating life.

SUMMARY OF THE INVENTION

Therefore, it is an object of the invention to indicate a device of the type disclosed above which avoids the disadvantages inherent in the state of the art. In particular, the device is to provide convective cooling means by which the ballasts of fluorescent lighting fixtures can be kept cool for increased operating life.

It is therefore an object of the present invention to provide an improved fluorescent light ballast cooling means consisting of a cooling fan that blows ambient air on the lighting ballast in one mode, and alternately, draws cooling air from a ventilation duct in another mode The main features of this invention are the holes in the ballast housing compartment to allow air to flow into the ballast from a fan or duct.

Briefly described according to one embodiment of the present a flourescent light is provided with an integral fan for cooling purposes. The invention strongly resembles a conventional lighting fixture with the addition of a small cooling fan that blows air over the ballast. The air is filtered by a small replaceable filter that keeps dust and dirt out of the fixture. The fan is wired in parallel with the light fixture such that the fan comes on automatically whenever the fixture is energized. Air vents are also placed in the housing for both the entrance and exit of the air. Since the cooling properties are dependent upon the temperature of the ambient air, it is envisioned that if the ambient air is 75° or less, direct ambient air would be drawn into the invention. If the ambient temperature is 75° or higher, a duct system would be used to provide cool air.

The present invention is envisioned to be adaptable to all types of fluorescent fixtures, such as surface mount, lay-in fluorescents, industrial fluorescents and the like.

The present invention is envisioned as being especially advantageous in those locations that are hard to reach such as high ceiling spaces and the like where maintenance costs for ballast replacements are high.

The use of the present invention allows for longer life of ballasts used on fluorescent lighting fixtures in an easy and simple manner.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DETAILED DESCRIPTION

Figure 1:
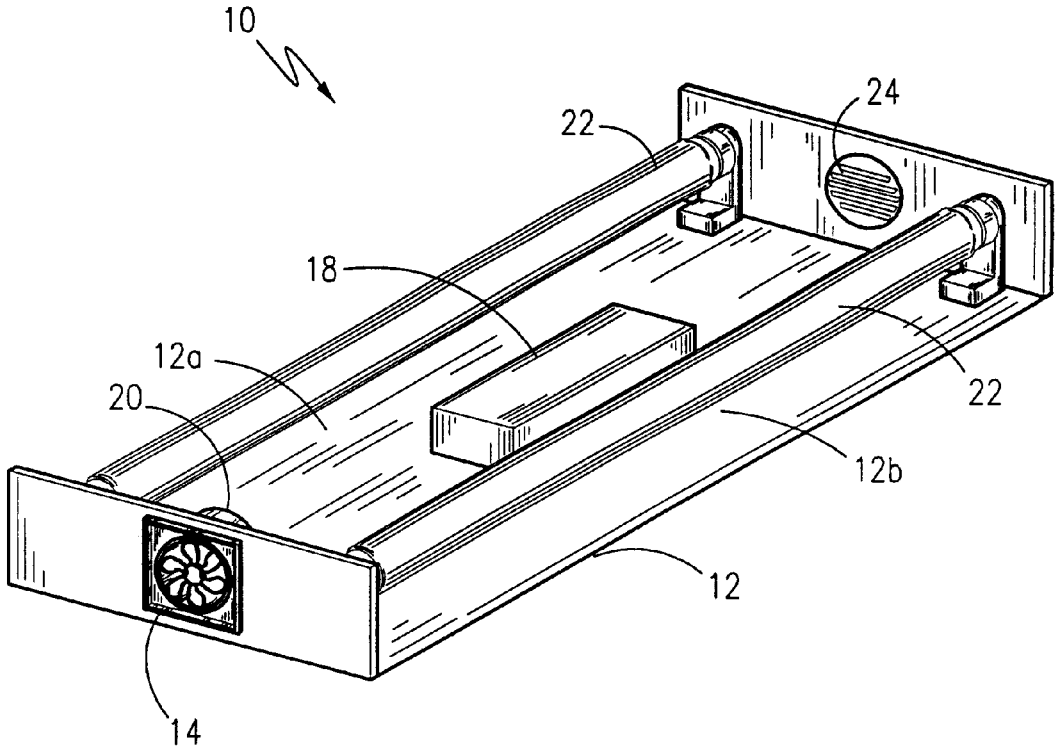
FIG. 1 is a perspective view of a fluorescent light ballast cooling means according to the preferred embodiment of the present invention.
Figure 2:
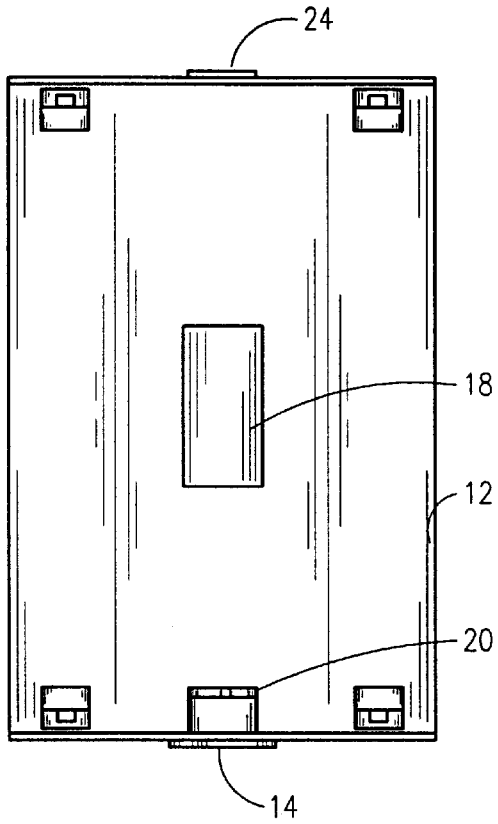
FIG. 2 is a bottom plan view thereof, shown with light tubes removed.
Figure 3:
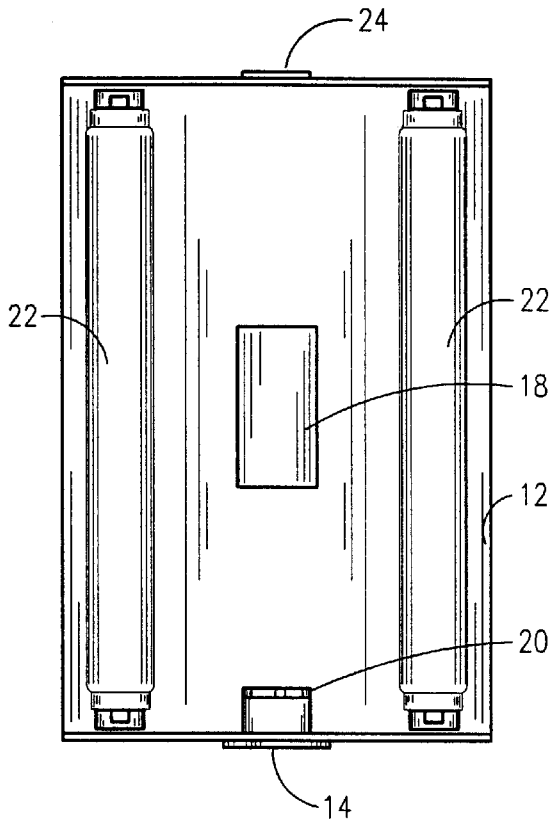
FIG. 3 is a bottom plan view thereof, shown with light tubes installed.
Figure 4:
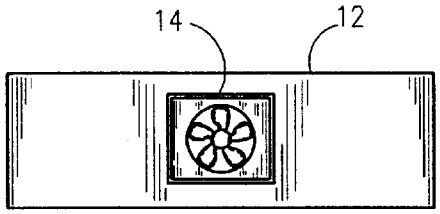
FIG. 4 is a left side elevational view thereof.
Figure 5:
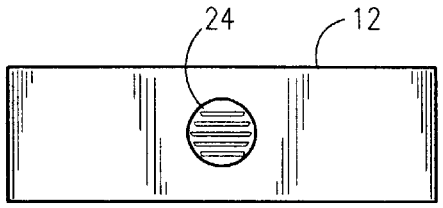
FIG. 5 is a right side elevational view thereof.

Referring now to FIGS. 1–5, a fluorescent light ballast cooling means, generally noted as 10, is shown, according to the present invention. A flourescent light 12 formed of an otherwise conventional housing 12*a* for supporting a single, or a plurality of fluorescent lighting tubes 12*b* is provided with an integral fan 14 for cooling purposes. The small cooling fan 14 blows air over the ballast 18. The air is filtered by a small replaceable filter 20 that keeps dust and dirt out of the fixture 12. The fan 14 is wired in parallel with the light fixture 22 such that the fan 14 comes on automatically whenever the fixture is energized. Air vents 24 are also placed in the housing for both the entrance and exit of the air.

Since the cooling properties are dependent upon the temperature of the ambient air, it is envisioned that if the ambient air is 75° F. or less, direct ambient air would be drawn into the invention. If the ambient temperature is 75° F. or higher, a duct system would be used to provide cool air.

As designed, a device embodying the teachings of the present invention is easily applied. The foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. Therefore, the scope of the invention is to be broadly limited only by the following claims.

What is claimed is:

1. A fluorescent light ballast cooling means comprising:

a light housing for supporting at least one fluorescent lighting tubes of the type requiring a lighting ballast for activation;

said lighting ballast mounted within said housing; and a fan for blowing air into said housing:

wherein said fan penetrates said housing such as to provide fluid communication between an interior housing space and the exterior of said housing and across said lighting ballast and further wherein said fan is wired in parallel with a light fixture such that said fan is initiated comes on automatically whenever said fixture is energized.

2. The fluorescent light ballast cooling means of claim 1 further comprising a replaceable filter covering the fan penetration of said housing.

3. The fluorescent light ballast cooling means of claim 1, further comprising air vents in said housing for both the entrance and exit of the air.

* * * * *